US010209043B2

(12) United States Patent
Morris

(10) Patent No.: US 10,209,043 B2
(45) Date of Patent: Feb. 19, 2019

(54) MORRIS 80 PLASTIC SHARK BOLT

(71) Applicant: Elgie A. Morris, Grants Pass, OR (US)

(72) Inventor: Elgie A. Morris, Grants Pass, OR (US)

( * ) Notice: Subject to any disclaimer, the term of this patent is extended or adjusted under 35 U.S.C. 154(b) by 136 days.

(21) Appl. No.: 15/362,267

(22) Filed: Nov. 28, 2016

(65) Prior Publication Data

US 2018/0149453 A1 May 31, 2018

(51) Int. Cl.
*F42B 6/06* (2006.01)
*F42B 6/04* (2006.01)
*F42B 10/04* (2006.01)

(52) U.S. Cl.
CPC ..... *F42B 6/06* (2013.01); *F42B 6/04* (2013.01); *F42B 10/04* (2013.01)

(58) Field of Classification Search
CPC ..... F42B 6/06; F42B 6/04; F42B 6/08
See application file for complete search history.

(56) References Cited

U.S. PATENT DOCUMENTS 3,031,797 A * 5/1962 Gelfand ..... A63H 27/14 124/26
3,846,878 A * 11/1974 Monson ..... F42B 6/04 86/51
3,851,590 A * 12/1974 LaCosta ..... F42B 6/04 102/501
3,861,314 A * 1/1975 Barr ..... F42B 6/04 102/501
4,696,281 A * 9/1987 Nishioka ..... F42B 6/00 124/25
8,157,680 B2 * 4/2012 Anderson ..... F42B 6/04 473/578
2013/0123051 A1 * 5/2013 Pierce ..... F42B 6/08 473/577

* cited by examiner

*Primary Examiner* — Joshua T Kennedy

(57) ABSTRACT

When combined with a metal point, this ten inch plastic pistol crossbow bolt is designed to extend past the barrel of a pistol crossbow so it can be used for recreational shooting, competition shooting, small game hunting, pistol crossbow fishing and pistol crossbow scuba fishing.

The main fault of the standard bolt for a pistol crossbow is they are less than seven inches in length and do not extend past the end of a pistol crossbow barrel. Therefore, their use is limited to target points and recreational shooting only. Other faults of the standard short bolts are their high travel speed. They are very difficult to be viewed in flight, causing most bolts to be lost after one use. Also, their irretrievability from any commonly used target. Therefore, they cannot be found and scored in any type of shooting competition.

This ten inch bolt is a solid one piece unit made of a strong but, light weight plastic compound. It has a NOCK to securely hold the bow string in place. Most bolts do not have a nock. It has two FLAT WINGS and a stabilizing TAIL which creates an accurate and stable bolt flight. No other bolt has flat wings or a tail. These features allow this bolt to be easily viewed in flight. This also allows this bolt to be used for competition shooting because these bolts can be easily located, scored and then retrieved from any type competition target. The shaft has a THREADED TIP to accept almost any type metal point.

1 Claim, 4 Drawing Sheets

(1)

MORRIS 80 PLASTIC SHARK BOLT

RELATED APPLICATIONS

Provisional Application #62/404,601
Filing Date: 1010512016
Title of Patent Application: Morris 80 Plastic Shark Bolt

STATEMENT REGARDED FEDERALLY SPONSORED RESEARCH

Not Applicable

NAMES OF PARTIES IN JOINT RESEARCH AGREEMENT

Not Applicable

INCORPORATION-BY-REFERENCE OF MATERIAL

Not Applicable

STATEMENT REGARDING PRIOR DISCLOSURES BY INVENTOR OR JOINT INVENTOR

Not Applicable

BACKGROUND OF INVENTION

This plastic pistol crossbow bolt is made for the fifty to eighty pound pistol crossbows. It is nine and one quarter inches in length with a threaded tip to receive a metal point. Total length of this bolt will depend on the length of any metal point used. This new bolt solves many problems often found with the restricted uses of the bolts commonly used with pistol crossbows.

The commonly used pistol crossbow bolts are about six inches in length. Those short bolts cause lack of visibility during flight, difficulty in locating upon impact and irretrievability of those short bolts after impact into any standard target. For that reason, those short pistol crossbow bolts cannot be used for any tournament competition, small game hunting, pistol crossbow fishing or pistol crossbow scuba fishing. The MORRIS 80 PLASTIC SHARK BOLT solves those problems.

Any pistol crossbow bolts, made of metal and designed with sufficient length to solve some of the above stated problems, require some type of fetches be attached to those bolts for stability during flight. During use, those fletches often becomes loosened and requires constant reattachment and repair. That becomes is a major problem with the metal pistol crossbow bolts. The MORRIS 80 PLASTIC SHARK BOLT is a one piece solid plastic unit including two wings and a tail for stabilization. It does not require added fletches be glued into place or continued reattachment of fletches.

SUMMARY OF THIS INVENTION

A plastic pistol crossbow bolt created by injection mold. Bolt composition is durable plastic with nylon reinforcement. Bolt is nine and one quarter inches in length. Bolt is designed with two wings to stabilize bolt elevation and a tail to stabilize directional flight. Bolt has a threaded tip designed to extend past the barrel end and, use a variety of metal points included target, hunting, fishing and field points. No other pistol crossbow bolt is designed with two wings and a tail and, uses this variety of points. This plastic pistol crossbow bolt, with its extended length, unique design and versatility in point usage, is designed to totally change and enhance the way any pistol crossbow is used.

DESCRIPTION

DESCRIPTION

Figure 1:
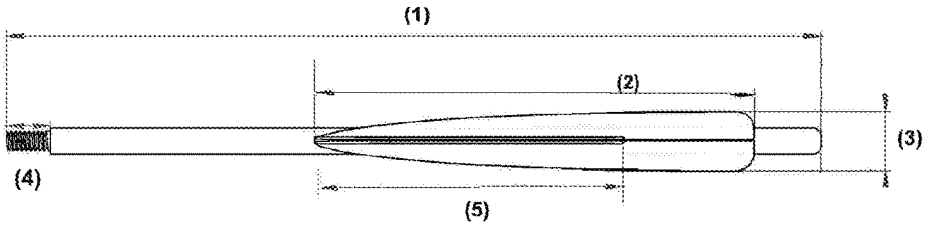
FIG. 1 shows the pistol crossbow bolt of the present invention viewed from above.
Figure 2:
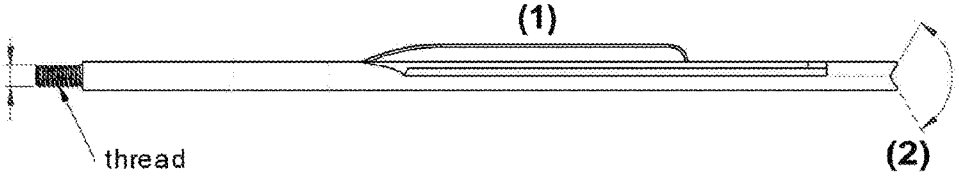
FIG. 2 shows the pistol crossbow bolt of the present invention viewed from side.
Figure 3:
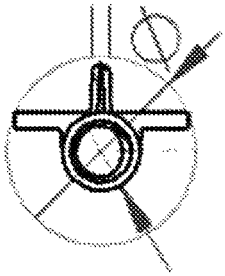
FIG. 3 shows the pistol crossbow bolt of the present invention viewed from tip end.
Figure 4:
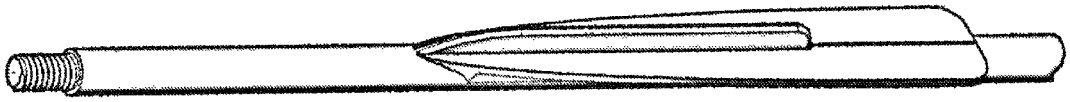
FIG. 4 shows a three dimensional view of the pistol crossbow bolt of the present invention.

The pistol crossbow bolt (1) is nine and one quarter inches in length (FIG. 1). The bolt shaft (3) is five-sixteenths of an inch in diameter (FIG. 1) and is dowel shaped (FIG. 3). The bolt is a solid durable light weight plastic with nylon reinforcement. Bolt includes a nock (2), two flat wings (2), a tail (5), a shaft (1) and a threaded tip (4) to receive a variety of metal points. Each of the two side wings are flat and level with the top of the shaft (FIG. 3). Each wing is five inches long (FIG. 1) and one-sixteenth of an inch thick (FIG. 3). Each wing is tapered from five-sixteenths of an inch width down to approximately one-sixteenth of an inch width starting three-quarters of an inch from the nock down the length of the five inch wing (FIG. 1). The tail (5) is three and one half inches long (FIG. 1) and one-sixteenth of an inch thick (FIG. 3). The tail is three-sixteenths of an inch tall and tapered down on each end (FIG. 2). This bolt, when fitted with a metal point, is designed to reach or extend past the end of any pistol crossbow barrel.

The invention claimed is:

1. A plastic pistol crossbow bolt designed for use with a pistol crossbow having a barrel, comprising:

a shaft comprising a solid one piece injection molded plastic unit having a length of approximately nine and one half inches with a nock on a first end which is configured to securely hold a string of a pistol crossbow;

two flat wings level with an upper surface of the shaft to control elevation during bolt flight;

a single stabilizing tail projecting upward from said upper surface along a diametrical line of the shaft to stabilize vertical flight; and a threaded end piece on a second end configured to accommodate a variety of steel points.

* * * * *